United States Patent [19]

Kearney

[11] Patent Number: 4,680,082

[45] Date of Patent: Jul. 14, 1987

[54] LABEL APPLICATOR

[75] Inventor: David A. Kearney, Keene, N.H.

[73] Assignee: Markem Corporation, Keene, N.H.

[21] Appl. No.: 784,507

[22] Filed: Oct. 4, 1985

[51] Int. Cl.[4] ..... B65C 9/18; B65C 9/28

[52] U.S. Cl. ..... 156/497; 156/542; 156/584; 156/DIG. 33; 156/DIG. 38; 221/73

[58] Field of Search ..... 156/497, 541, 542, 584, 156/DIG. 33; 221/73, 211, 278

[56] References Cited

U.S. PATENT DOCUMENTS

| | | | |
|---|---|---|---|
| 2,163,441 | 6/1939 | Von Hofe | 294/64.1 |
| 2,492,908 | 12/1949 | Von Hofe | 156/538 |
| 3,093,528 | 6/1963 | Reich | 294/64.1 |
| 3,379,466 | 4/1968 | Hughes | 271/8.1 |
| 3,428,509 | 2/1969 | Messmer | 156/542 |
| 3,562,067 | 2/1971 | Kucheck | 156/542 |
| 3,645,832 | 2/1972 | Sauer | 156/541 |
| 3,655,492 | 4/1972 | Burton | 156/384 |
| 3,729,362 | 4/1973 | French et al. | 156/541 |
| 3,885,705 | 5/1975 | French | 156/541 |
| 3,888,725 | 6/1975 | French | 156/541 |
| 3,944,455 | 3/1976 | French | 156/542 |
| 3,984,277 | 10/1976 | French et al. | 156/541 |
| 4,025,382 | 5/1977 | Del Rosso | 156/497 |
| 4,046,613 | 9/1977 | Kucheck et al. | 156/285 |
| 4,059,203 | 11/1977 | Wright | 156/542 |
| 4,089,725 | 5/1978 | Crankshaw et al. | 156/542 |
| 4,101,366 | 7/1978 | Teraoka et al. | 156/384 |
| 4,124,429 | 11/1978 | Crankshaw | 156/584 |
| 4,132,583 | 1/1979 | Hodgson | 156/493 |
| 4,189,337 | 2/1980 | Higgins et al. | 156/497 |
| 4,191,605 | 3/1980 | Katterheinrich et al. | 156/285 |
| 4,255,220 | 3/1981 | Kucheck et al. | 156/249 |
| 4,276,112 | 6/1981 | French et al. | 156/384 |
| 4,337,108 | 6/1982 | Crankshaw et al. | 156/542 |
| 4,367,118 | 1/1984 | Karp | 156/541 |
| 4,378,665 | 4/1983 | Crankshaw et al. | 53/69 |
| 4,392,913 | 7/1983 | Baumli | 156/542 |
| 4,432,830 | 2/1984 | Jue | 156/384 |
| 4,473,429 | 9/1984 | Crankshaw | 156/497 |
| 4,475,978 | 10/1984 | Bartl | 156/542 |
| 4,566,933 | 1/1986 | Crankshaw et al. | 156/542 |

*Primary Examiner*—Michael Wityshyn

*Attorney, Agent, or Firm*—Robbins & Laramie

[57] ABSTRACT

A label applicator is disclosed for receiving pressure-sensitive labels which have been peeled from a backing strip and for applying the labels to a desired surface. The tendency of the labels to bunch or wrinkle as they are delivered to the applicator face is avoided by causing the labels to bow or curve outward slightly from the plane of the face plate, with the bowing or curvature occurring across the width of the label in a direction transverse to the feed direction. The bowing increases the longitudinal stiffness of the label in the feed direction, and allows the label to be pushed across the applicator face without bunching or wrinkling even when relatively long and narrow labels are employed.

6 Claims, 8 Drawing Figures

LABEL APPLICATOR

BACKGROUND OF THE INVENTION

The present invention relates generally to label applicators, and is particularly concerned with a vacuum or suction applicator for receiving pressure-sensitive labels peeled from a backing strip and for applying the labels to a desired surface.

Various types of devices employing positive or negative air pressure, or both, have been proposed for use in applying adhesive-backed labels to cartons, bottles, and similar articles. One such device, employing both positive and negative pressure, consists of a hollow enclosure or housing having one wall formed with openings therein to serve as a label retaining grid. The interior of the enclosure is partially evacuated by means of an exhaust fan or other source of vacuum, causing the label to adhere to the grid by virtue of ambient air pressure. When it is desired to apply the label to an article surface, a short burst of compressed air is applied through selected portions of the grid in order to propel the label toward the article surface. The negative pressure within the enclosure is generally applied continuously, rather than intermittently, but the intermittent bursts of compressed air that are applied to the label through the selected grid openings are of sufficient force to overcome the adhesion of the label to the grid. This results in a somewhat simplified structure since it is not necessary to switch off the source of vacuum each time that a label is applied.

In one arrangement, the burst of compressed air is supplied through a plurality of flexible tubes connected to selected openings in the grid, these openings being selected to correspond generally with the shape or outline of the label to be applied. The remaining openings are left open to communicate with the interior of the enclosure, in order to provide the vacuum or suction which is necessary to adhere the label to the grid.

A label applicator of the type just described may be used to apply pressure-sensitive labels which have been peeled from a continuous backing strip by means of a stripper or peeler device located adjacent to the applicator. As the label is peeled from the backing strip, it moves across the face of the applicator grid and is held thereon with its adhesive side facing outwardly. As will be readily apparent, the degree of friction between the label and the applicator grid will increase progressively as more of the label is delivered to the applicator. This friction will exert a rearward force on the label tending to oppose the forward force exerted by the motion of the backing strip across the stripper edge. The combined effect of the forward force exerted on the label at the stripper edge, and the opposing force exerted on the label by frictional contact with the applicator grid, is to exert a buckling force on the label that may cause it to become wrinkled or bunched as it travels over the applicator grid. This condition must be avoided since the wrinkling or bunching will prevent the labels from being properly applied to the articles, and can result in jamming of the label applicator and feed mechanisms.

In order to reduce the friction between the label and the applicator grid, it has been proposed to form the grid with a plurality of parallel, spaced-apart ribs extending in the direction of label movement. The recessed spaces between adjacent ribs contain rows of holes communicating with the interior of the enclosure, or, in the case of certain holes, with the compressed air source. This arrangement has the advantage that the ribs provide a reduced area of contact between the label and the applicator grid, thereby reducing friction. In addition, since the holes are recessed away from the rib surfaces, the label edges cannot become caught on the edges of the holes.

Unfortunately, the use of parallel ribs on the surface of the applicator grid has not provided a complete solution to the problem of label wrinkling or bunching caused by excessive friction. As the length of the label is increased, the amount of friction between the label and the applicator grid increases, and furthermore, the resistance of the label to buckling decreases because of the change in the aspect ratio of the label (i.e., the relationship between its width and its length). As a result of these two factors, a limit on the maximum length of the label is quickly reached even if measures are taken to reduce friction somewhat. The thickness and stiffness of the label material will obviously have an important bearing on its resistance by buckling, and, in theory at least, it is possible to avoid the problem by employing a more rigid label material when longer labels are to be applied. In practice, however, it is desirable for reasons of economy and convenience to be able to use conventional types of label stock without regard to the size of the labels to be applied. Also, the operation of the label feeding and handling apparatus may impose certain constraints on the thickness or rigidity of the label stock, and these constraints may not be compatible with the requirements of the label applicator.

SUMMARY OF THE INVENTION

In accordance with the present invention, the foregoing limitations and disadvantages of the prior art are substantially avoided by providing the grid or face plate of a label applicator with means for causing the adhered label to bow or curve outward from the plane of the face plate, with the bowing or curvature occurring across the width of the label in a direction transverse to the feed direction. The bowing increases the longitudinal stiffness of the label in the feed direction, and allows the label to be pushed across the applicator face without bunching or wrinkling even when relatively long and narrow labels are employed. The desired effect is obtained even when the amount of bowing is relatively slight, and hence the label can still be maintained in a relatively flat condition against the applicator face to facilitate proper transfer of the label to the surface of an article.

In a preferred embodiment, the face plate of the label applicator is formed with a plurality of raised parallel bars which are spaced apart from each other to define a grid-like label receiving surface, and the openings in the face plate are formed in the recessed areas between adjacent bars. In this embodiment, the means for causing the label to bow outward from the plane of the face plate may comprise at least one of the bars which is raised outward from the plane of the face plate by a distance greater than the adjoining bars.

The present invention is of particular utility in connection with with an on-demand label printing and applying apparatus in which the print head is located immediately adjacent to the label stripping and applying station. In this type of apparatus, the leading portion of a label is delivered to the applicator while the trailing portion of the same label is still being printed. As a result, any wrinkling or folding of the label on the applicator face will not only cause the label to be improperly applied to the article, but may also result in improper registration of the label with respect to the print head. This is particularly undesirable in situations where the printed legends include optical bar codes or other types of machine-readable indicia requiring precise printing registration.

BRIEF DESCRIPTION OF THE DRAWINGS

The various objects, advantages and novel features of the invention will be more readily appreciated from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
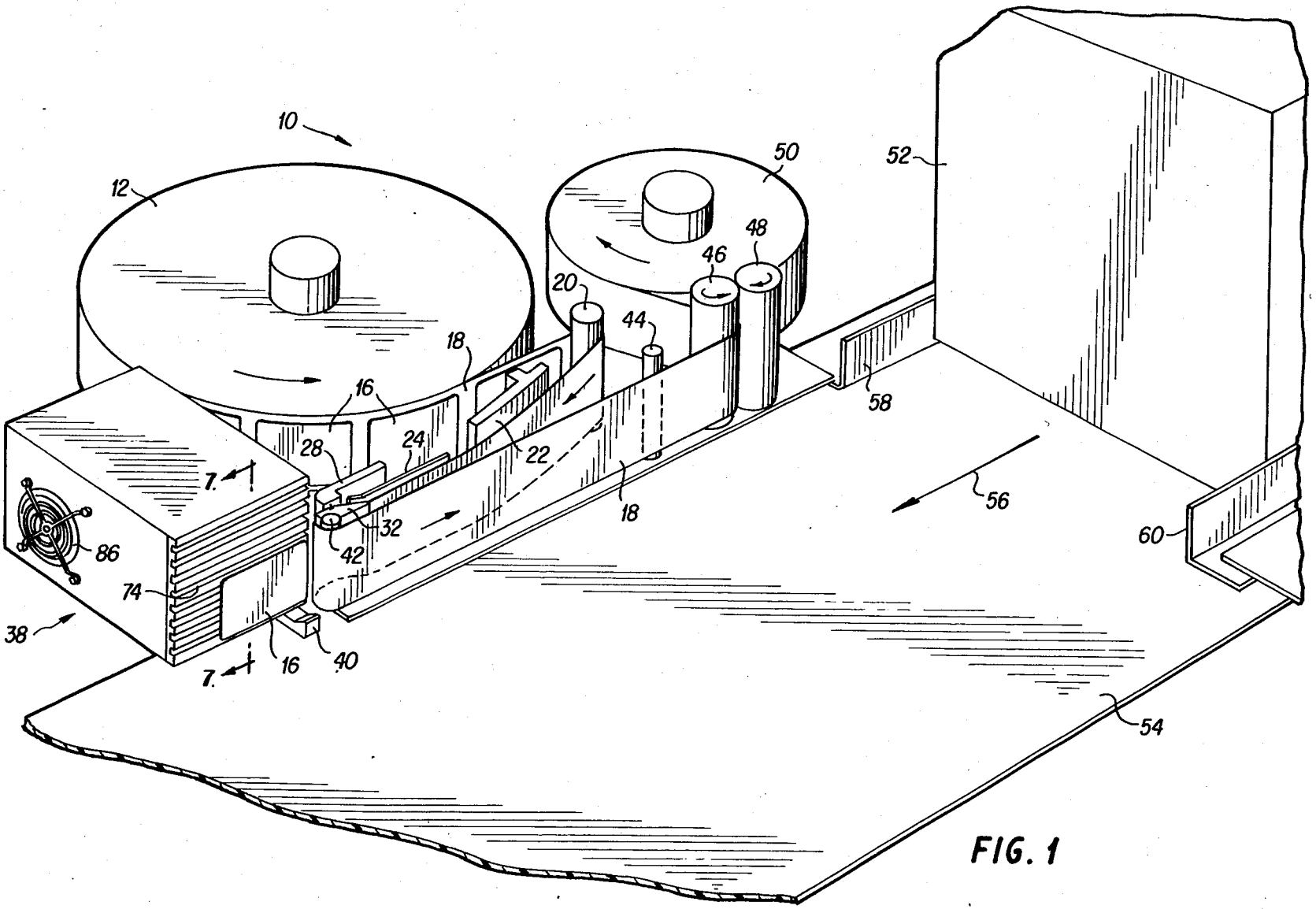
FIG. 1 is a perspective view of a thermal label printing and applying apparatus system incorporating the improved label applicator of the present invention.
Figure 2:
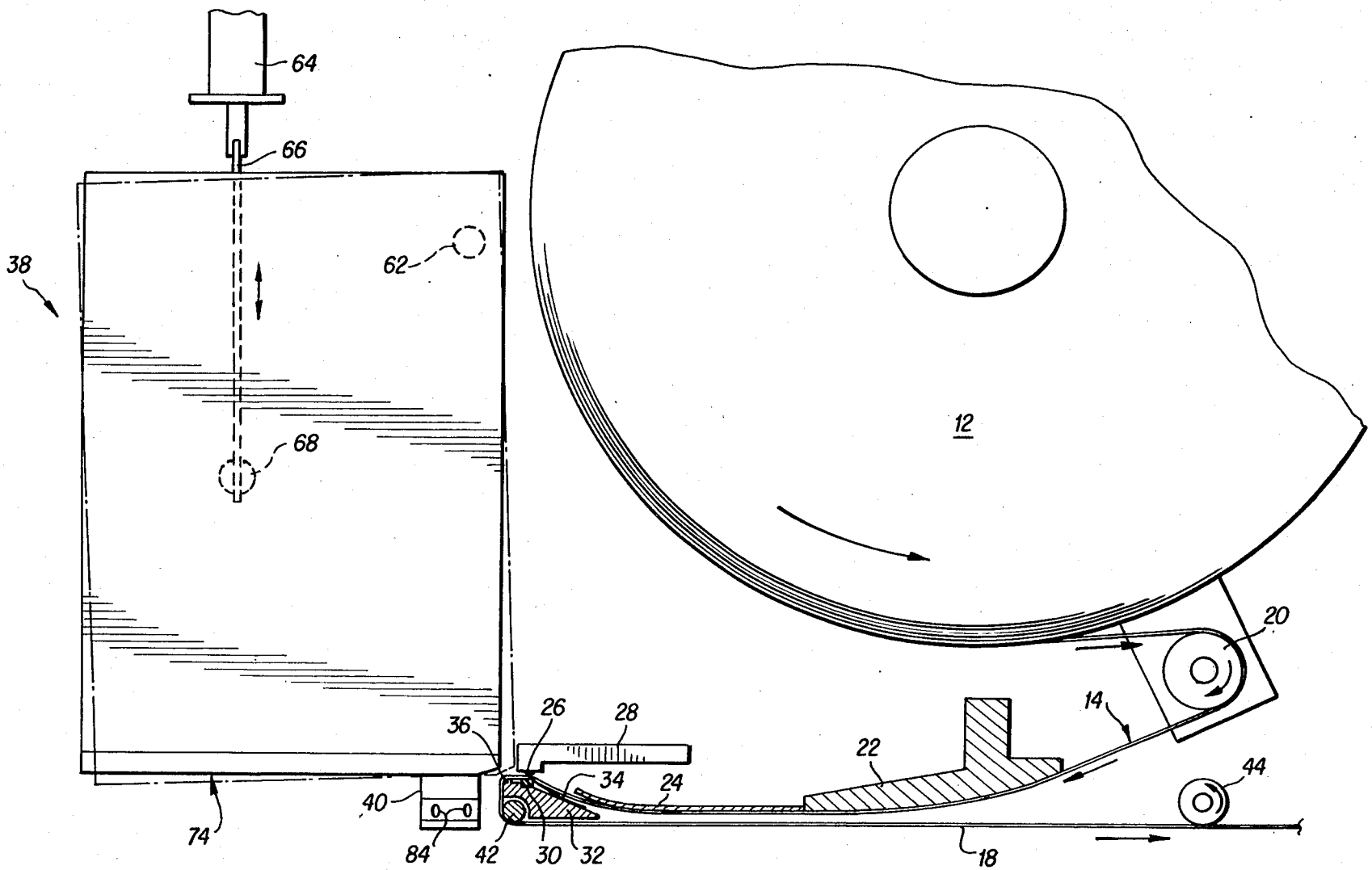
FIG. 2 is an enlarged top view of the label printing, stripping and applying stations of the apparatus shown in FIG. 1.

FIGS. 1 and 2 illustrate a thermal label printing and applying apparatus 10 which incorporates the improved label applicator of the present invention. In a typical application, the apparatus 10 may be used to print labels indicating the weight, identity or other characteristic of a product carried on a conveyor, in response to a signal received from a scale or other device located at an upstream position on the conveyor. The apparatus 10 includes a supply roll 12 which delivers a label strip 14 comprising a plurality of individual, pre-cut pressure sensitive labels 16 carried on a continuous backing strip 18. In the illustrated embodiment, the labels 16 consist of paper which has been coated with a thermally sensitive layer to allow thermal printing to be carried out, but the invention is equally applicable to other types of labels and printing methods. The label strip 14 is threaded around a dancer and brake roll 20 and is carried across a heating shoe 22 located upstream of the printing station. The heating shoe 22 contains internal cartridge heaters (not shown) and is held in contact with the labels 16 in order to preheat the labels to a temperature sufficient to allow thermal printing to occur at the print head. This is particularly advantageous in cases where the apparatus 10 is used under conditions of low ambient temperature, as would occur, for example, in a refrigerated meat packing plant.

From the heating shoe 22, the label strip 14 passes across a guide plate 24 and is brought into contact with a thermal print head 26 supported by a holder 28. The thermal print head is of the dot matrix type and operates under the control of a computer (not shown) to form the desired legends, which may include bar codes as well as alphanumeric data, on the thermally sensitive labels 16 as they pass through the printing station. The computer and its method of operation form no part of the present invention and will not be described further herein. At the printing station, the label strip 14 is held between the thermal print head 26 and a strip 30 of resilient material, such as rubber, which provides a compliant backup layer and allows the print head to make intimate contact with the label strip. The resilient strip 30 is supported by a stripper or peeler device 32 over which the label strip 14 passes. A wear strip 34 is secured to the stripper device 32 and extends into the area between the thermal point head 26 and the resilient backup layer 30. When the label strip 14 is in place, the wear strip 34 is interposed between the back side of the label strip and the surface of the resilient backup layer 30 in order to prevent pressure wearing of the backup layer as a result of frictional contact with the label strip. A fine mesh stainless steel screen is the preferred material for the wear strip 34, although other materials may be used. Examples include glass-impregnated Teflon, Mylar, aluminized Kapton, and stainless steel foils. The resilient strip 30 may be replaced by a rubber-covered backup roller, if desired, and in that event it may not be necessary to provide the wear strip 34.

After emerging from the printing station, the label strip 14 is pulled across a stripper or peeler edge 36 at one end of the stripper device 32. The stripper edge is an abrupt 90° bend which causes the labels 16 to separate from the backing strip 18. This separation results from the inherent stiffness of the labels 16 and the relatively weak adhesive bond between the labels and the backing strip 18, which is intentionally provided with a smooth surface to promote release of the labels. As a given label 16 separates from the backing strip at the stripper edge 36, it is pushed along the front surface of a label applicator 38, with its adhesive side facing outwardly, by the motion of the backing strip 18. A nozzle 40 affixed to the bottom corner of the applicator 38 directs a flow of air toward the right-hand edge of the applicator face in order to urge the leading edge of the label into contact with the applicator face. The air flow from the nozzle 40 also assists somewhat in separating the labels from the backing strip 18. The label applicator 38, which will be described in more detail hereinafter, retains the label by means of a continuous internal vacuum or suction, and thereafter propels the label toward a desired surface by means of a short burst of positive air pressure that is sufficient to overcome the adherence of the label to he applicator face. In the apparatus of FIGS. 1 and 2, the close proximity of the print head 26 to the stripper edge 36 and applicator 38 is necessary since the labels will usually contain data (e.g., weight) that is specific to individual articles on a moving conveyor, and hence it is desired to present a printed label to the applicator 38 as soon as possible after the data is made available to the print head.

After passing over the stripper edge 36, the backing strip 18 passes over a steel or Delrin roller 42 which is carried by the stripper device 32. The purpose of the roller 42 is to reduce the amount of friction experienced by the backing strip as it is pulled around the stripper device 32. In cases where the resilient backup layer 34 opposite the thermal print head 26 is replaced with a rubber-covered roller, the friction on the label strip is reduced and the additional roller 42 may be omitted. From the roller 42, the backing strip 18 passes across a guide roller 44 and then between a pair of pinch rollers 46, 48. The pinch rollers 46, 48 are driven by a suitable motor and control system, and serve as the drive mechanism for pulling the label strip 14 through the various stations of the apparatus 10. The pinch rollers operate intermittently and in synchronism with the operation of the print head 26. This operation is such that the label strip is in motion during the intervals when a label is being printed and delivered to the face of the applicator 38, but is halted during the intervals when the applicator 38 is applying a printed label to an article surface. After passing through the pinch rollers 46, 48, the backing strip 18 is taken up by a motor-driven rewind roll 50.

In the illustrated embodiment, the article to be labelled is a carton 52 that is being carried by a conveyor 54 in the direction indicated by the arrow 56. It should be noted that the direction shown is merely exemplary, and that the applicator 38 is capable of applying a label to an article moving in any direction or to an article which is motionless. A pair of guides 58, 60 insure that the carton 52 is properly oriented on the conveyor 54 and is at the proper distance from the face of the label applicator 38. During the interval when a label is being delivered to the face of the applicator 38, the applicator is tilted slightly so as to overlap the stripper edge 36 as indicated by the plantom line position in FIG. 2. This orientation of the applicator 38, together with the action of the air nozzle 40 of FIG. 1, insures that the leading edge of the label makes contact with the face of the applicator during the initial portion of the label delivery. After the label has been completely applied to the face of the applicator 38, the applicator pivots slightly to the solid line position of FIG. 2. This pivoting motion insures that the label is completely separated from the backing strip 18, and also provides a slight clearance between the stripper edge 36 and edge of the applicator face in order to insure that the label is not obstructed as it is propelled toward the article surface. When the applicator 38 is in the label applying position, corresponding to the solid line position of FIG. 2, the face of the applicator is parallel to the side surface of the carton 52 in FIG. 1. The pivoting of the applicator 38 occurs about a vertical shaft 62 located near the rear inner corner of the applicator as indicated in FIG. 2. The pivoting is initiated by means of an electrical solenoid 64 which is affixed to the frame of the apparatus 10 and has its plunger or armature 66 connected to a pivotable fitting 68 on the bottom of the applicator 38.

Figure 3:
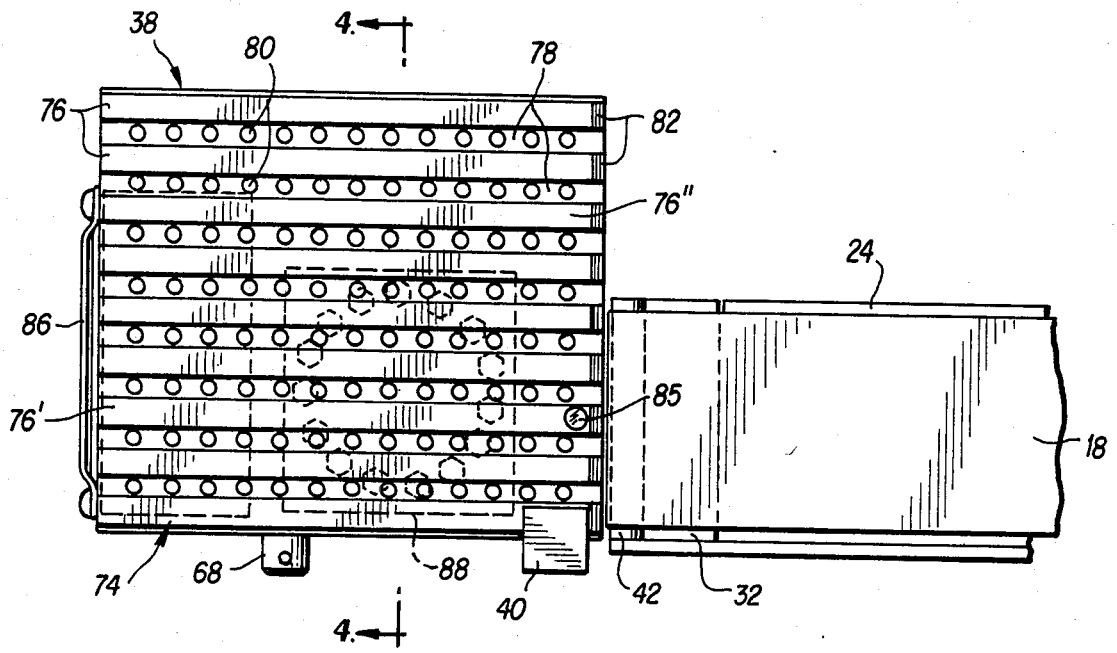
FIG. 3 is a front elevational view of the label applicator and the adjacent portion of the stripper assembly.
Figure 4:
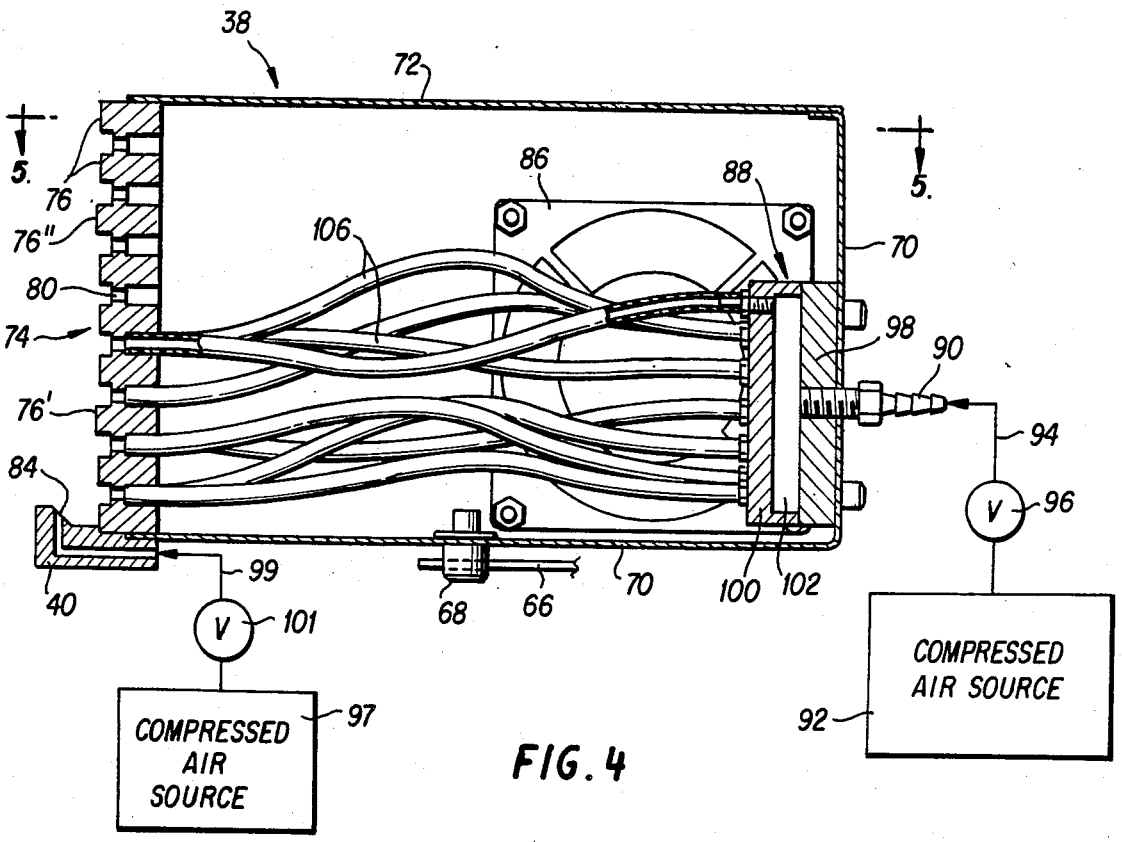
FIG. 4 is a side sectional view of the label applicator, taken along the line 4—4 in FIG. 3.
Figure 5:
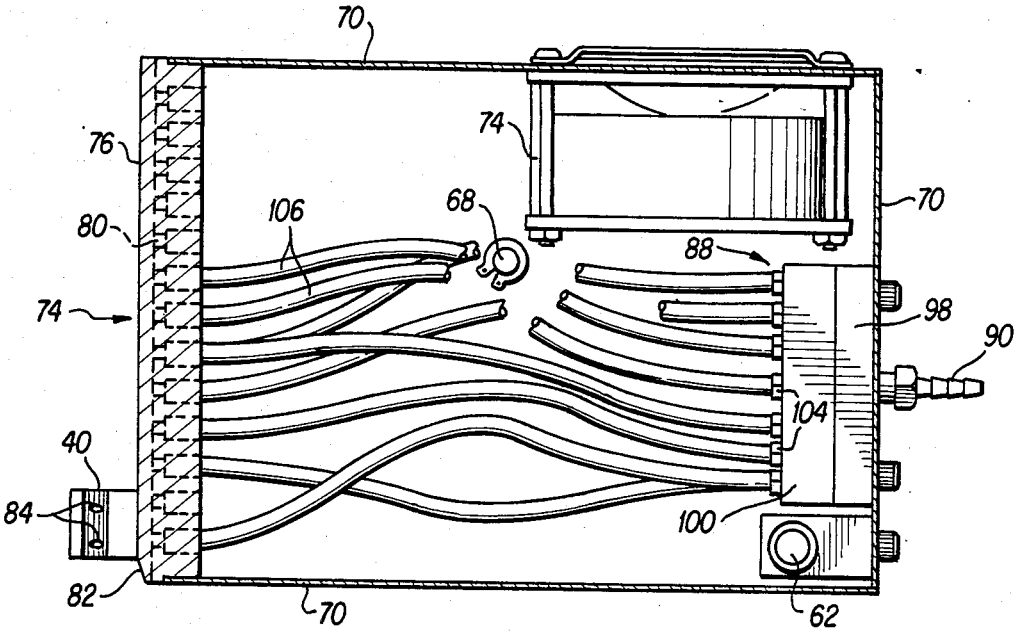
FIG. 5 is a top sectional view of the label applicator, taken along the line 5—5 in FIG. 4.
Figure 6:
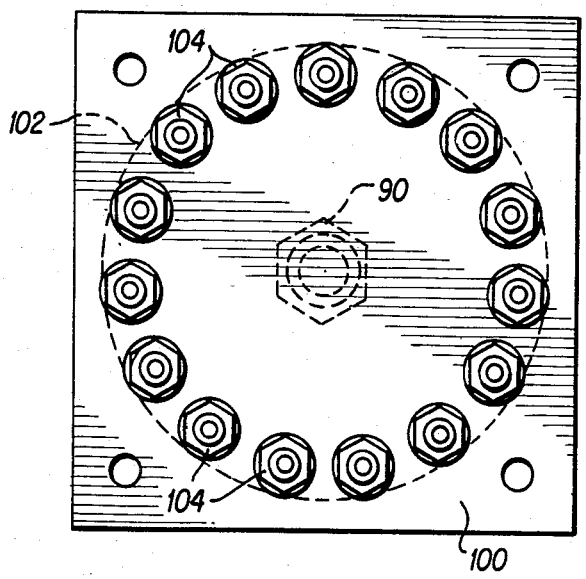
FIG. 6 is an enlarged front elevational view of the air manifold that is used for supplying compressed air to selected locations on the face plate of the applicator.

The details of the label applicator 38 are illustrated in FIGS. 3–6. The applicator 38 includes an outer housing or enclosure 70, generally in the shape of a box or parallelepiped. The top cover 72 of the housing is removable by means of screws or the like (not shown) in order to allow access to the interior of the housing. The front of the applicator 38 comprises a generally planar face plate 74 which is formed with a plurality of integral raised bars 76 which are parallel to and spaced apart from each other to define a grid-like label receiving surface. The bars 76 are rectangular in cross-section and extend horizontally across the applicator face so that they lie along the direction in which labels are delivered to the applicator face from the stripper device 32. In accordance with the present invention, certain ones of the bars 76, indicated at 76′ and 76″ in FIGS. 3 and 4, are raised outward from the plane of the face plate 74 by a distance greater than the remaining bars. The enlarged bars 76′, 76″ induce a slight bowing or curvature of the labels as they move across the face plate 74, as will be described hereinafter. The recessed slots or channels 78 between adjacent bars 76 are provided with horizontal rows of holes 80 communicating with the interior of the housing 70. The arrangement of raised bars 76 alternating with the recessed areas 78 facilitates the release of the labels from the applicator and also provides a reduced area of contact between the labels 16 and the face plate 74, which is helpful in reducing the friction experienced by the labels when they are delivered to the applicator. Another advantage of this arrangement is that the holes 80 in the face plate are recessed away from the back side of the labels, thereby preventing the label edges from becoming caught on the edges of the holes. As best seen in FIGS. 3 and 5, the right-hand edges 82 of the bars 76, located adjacent to the stripper device 32, are beveled in order to allow the labels to transfer smoothly from the backing strip to the applicator 38 without becoming caught on the edge of the face plate 74. The transfer of the labels from the backing strip to the applicator is also assisted by the air nozzle 40, which contains a pair of air jets 84 directed upwardly and at an angle toward the right-hand edge of the face plate 74.

A hole 85, visible in FIG. 3, is formed through the lower enlarged bar 76′ at a position near the stripper device 32. The hole 85 communicates with the interior of the housing 70 and provides a mounting for a photoelectric sensor (not shown) which detects the presence of a label at the stripper edge. The absence of a label at the stripper edge during the label feeding interval is taken as an indication that a label is missing from the backing strip 18, and this condition initiates stoppage of the label printing and applying apparatus 10.

An exhaust fan 86 is mounted in a hole or cut-out formed in the left-hand side wall of the housing 70, and is adapted to be run continuously in order to partially evacuate the interior of the housing. With the top cover 72 in place, the housing is substantially airtight except for the fan opening and the holes 80 in the face plate 74. As a result, when the fan 86 is operating, a label 16 will adhere to the face plate 74 by virtue of the differential between ambient air pressure and the reduced or subatmospheric pressure within the housing 70. When it is desired to apply the label to the surface of an article, a short burst of positive air pressure is applied through selected ones of the holes 80 in order to overcome the adhesion of the label to the applicator face caused by the pressure differential and to forcibly propel the label in the direction of the article. This is accomplished by means of an air manifold 88 located within the housing 70 and affixed to the rear wall thereof. An air fitting 90 projects through the rear of the housing and is used to connect the manifold 88 to a compressed air source 92 by means of a suitable air line or conduit 94. A solenoid-controlled valve 96 is interposed in the air line 94 in order to allow compressed air to be supplied to the manifold 88 in short measured bursts. A separate compressed air source 97, conduit 99 and solenoid valve 101 are used to supply compressed air to the air nozzle 40, which is operated at different times and at a different pressure than the air manifold 88.

The air manifold 88 consists of a rear section 98 to which the fitting 90 is attached, and a forward section 100 which is formed with a circular interior cavity 102.

The outer surface of the front section 100 carries a plurality of air fittings 104 which communicate with the internal cavity 102. The air fittings 104 are arranged in a circular pattern at the periphery of the cavity 102 and are thus equidistant from the inside opening of the fitting 90, which is at the center of the cavity. This arrangement insures that the flow resistance to each of the fittings 104 is identical and thus provides equal air pressure to each fitting. The air fittings 104 are connected by lengths of flexible tubing 106 to selected holes of the face plate 74. As best seen in FIGS. 4 and 5, the holes 80 have a stepped cross-section so that they are of greater diameter on the inside of the face plate 74 than on the outside. This permits the ends of the flexible tubes 104 to be received in the interior portions of the holes 80 without extending through to the external surface of the face plate 74. The flexible tubes 106 are preferably all of the same length in order to equalize the air pressure in each tube.

It will generally be desirable to connect the flexible tubes 106 to the holes 80 in a pattern corresponding to the size and shape of the labels to be applied. To this end, it is preferred that the ends of the tubes 106 be releasably connected to the holes 80 so that the tubes may be removed and rearranged in order to suit labels of different shapes and sizes. In order to obtain proper operation of the applicator 38 for a label of a given size and shape, the tubes 106 are connected to certain of the holes 80 within the label area and the remaining holes are left open to communicate with the interior of the housing 70 and thus provide the vacuum or suction necessary to adhere the label to the face plate 74. Although the exact pattern in which the tubes 106 are arranged will be determined to some extent by experimentation, it will generally be found advantageous to locate a greater number of tubes near the edge of the label which corresponds to the direction in which the article to be labelled is moving. In FIG. 1, for example, the carton 52 will be labelled "on the fly" while it is moving in the direction of the arrow 56. In this situation, more of the tubes should be placed near the leading (i.e., left-hand) edge of the label 16 than near the trailing edge. This insures that the leading edge of the label will leave the applicator first, and will make contact with the carton 52 before the trailing edge. If desired, a spring-loaded roller may be provided downstream of the applicator 38 in order to insure that the labels are applied firmly and uniformly to the carton 52. The placement of the flexible tubes 106 will usually be more critical for large labels than for small labels, and will also be affected to some extent by the distance between the face plate 74 of the applicator and the surface to be labelled. If the surface is stationary, rather than moving, it is preferable to provide the greatest density of tubes in the central area of the label equidistant between its leading and trailing edges, so that the label will be projected from the applicator face with a slightly convex profile when viewed from the top or bottom. Depending on the size label that is employed, it may be necessary to connect all or only some of the flexible tubes 106 to the holes 80. On the average, approximately five holes should be left open within the label area for every hole that is connected to a tube, in order to insure that adequate suction is applied to the rear face of the label through the open holes. Unconnected tubes are left in the housing 70 and may be plugged if desired, although this will not usually be necessary.

Figure 8:
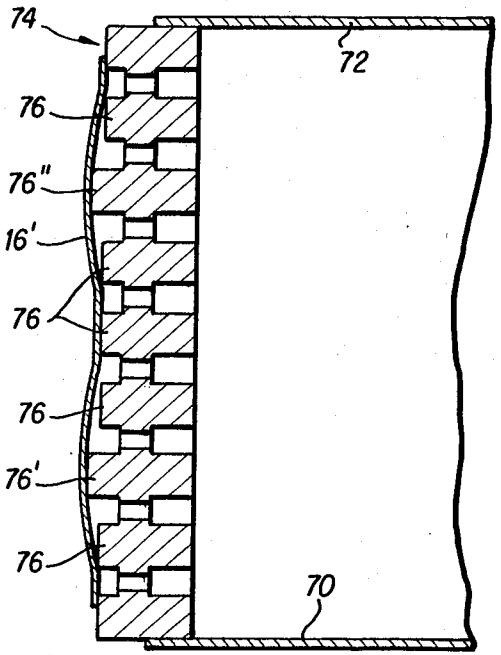
FIG. 8 is a sectional view similar to that of FIG. 7, illustrating the manner in which a wider label may be made to bow outwardly at two points by the use of a second enlarged bar on the applicator face plate.
Figure 7:
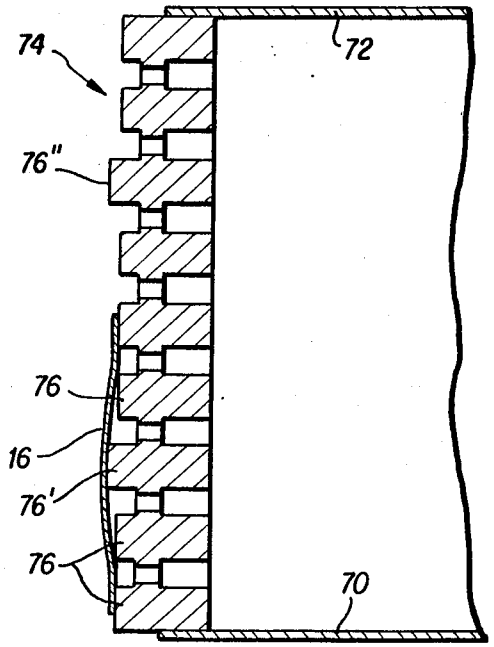
FIG. 7 is an enlarged sectional view taken along the line 7—7 in FIG. 1, illustrating the manner in which a narrow label is caused to bow outward slightly by means of an enlarged bar on the face plate of the applicator.

FIGS. 7 and 8 illustrate the manner in which the enlarged bars 76', 76'' on the face plate 74 of the label applicator 38 eliminate a problem that is sometimes encountered in connection with vacuum or suction-type label applicators. Referring for a moment to FIG. 1, it will be apparent that, as the label 16 is pushed across the face of the applicator 38 by the movement of the backing strip 18 across the stripper edge, there will be a progressive increase in the friction between the back side of the label and the face of the applicator. This friction exerts a rearward force on the label which acts in opposition to the forward force on the label at the stripper edge. The net result is to exert a buckling force on the label which, depending on the length and stiffness of the label, can cause it to become bunched or wrinkled, particularly in the area of the label near the stripper edge. This is a highly undesirable condition since it can prevent proper application of the labels to the article surfaces. In the label printing and applying apparatus 10 of FIG. 1, this condition is undesirable for the additional reason that any wrinkling or bunching of the labels in the area near the stripper 32 can affect the precise registration that must be maintained between the labels and the print head, which is of necessity located very close to the stripper edge. The problem is especially acute when bar codes or other machine-readable types of indicia are being printed, since a small error in print registration can cause the indicia to become unreadable.

The problem referred to above is eliminated by means of the enlarged bars 76', 76'' provided on the face plate 74 of the label applicator 38. As previously noted, these bars project outward from the plane of the face plate 74 by a distance greater than the remaining bars 76. The effect is to cause a slight outward bowing or curvature of the label 16 as it is pushed across the face plate 74 of the applicator, as illustrated in FIG. 7 for a narrow label (the flexible tubes 106 have been omitted in this figure). Such bowing or curvature occurs across the width of the label, that is, across the dimension transverse to the direction of label feed. Since the enlarged rib 76' extends completely across the face plate 74 of the applicator in the feed direction, the bowing or curvature of the label 16 will be approximately constant over the entire length of the label. The bowing or curvature imparts a longitudinal stiffness to the label in the feed direction, allowing the label to be pushed across the face plate of the applicator without the wrinkling or buckling that can occur with a perfectly flat label. Viewed another way, the intentional bowing of the label about a horizontal axis parallel to the feed direction makes it unlikely that the label will also buckle about a vertical axis transverse to the feed direction, given the inherent resistance of the label paper to form a compound curvature.

An additional benefit of the invention is that the bowing or curvature of the label 16 caused by the enlarged rib 76' results in a somewhat reduced area of contact between the label and the immediately adjoining ribs 76, as can be appreciated from FIG. 7. This, in turn, reduces the friction between the back side of the label and the face plate 74 of the applicator, and hence reduces the likelihood of bunching or wrinkling even further.

FIG. 8 illustrates the application of the present invention to a somewhat wider label 16', roughly twice the width of the label 16 of FIG. 7. As in the previous figure, the flexible tubes 106 have been omitted. The label 16' of FIG. 8 is wide enough to span both of the enlarged bars 76', 76'' on the face plate 74 of the applicator, and hence the bowing or curvature of the label occurs at two places along its width. The double curvature produces an effect somewhat like a corrugated sheet when the label is viewed in cross-section, thereby contributing greater longitudinal stiffness than would be obtained with a single curvature. If desired, additional enlarged bars or other types of projections can be added to the face plate of the applicator in order to produce additional zones of curvature and thereby enhance the corrugation effect.

The amount of bowing or curvature that is necessary to obtain the benefits of the present invention is relatively small, and hence it is still possible to allow the label to lie relatively flat against the face plate 74 of the applicator in order to facilitate the proper application of the label to an article surface. In an exemplary embodiment, the applicator face plate 74 has overall dimensions of 5.25 inches in width and 4.25 inches in height. The individual bars 76, 76', 76'' are 0.3125 inch wide and alternate with recessed areas 78 which are 0.1875 inch wide and 0.125 inch deep, measured from the plane surfaces of the non-enlarged bars 76. In this embodiment, the enlarged bars 76', 76'' need only be about 0.040 inch higher than the remaining bars 76 to produce adequate curvature in labels up to 4 inches in width and 5.25 inches in length. The difference in height between the enlarged bars 76', 76'' and the remaining bars 76 in FIGS. 7 and 8 has been exaggerated somewhat for the purpose of illustration.

Although the present invention has been described with reference to a preferred embodiment, the invention is not limited to the details thereof. For example, the desired bowing or curvature of the labels on the face plate of the applicator may be induced by means other than, or in addition to, the enlarged bars. Other types of projections such as rods, pins, and the like may be used for this purpose. Furthermore, the label applicator need not operate precisely as described, inasmuch as means other than compressed air may be used to transfer the labels from the applicator face to the article surface. To the extent that dimensions and material specifications have been set forth in the foregoing detailed description, it should be understood that these have been given by way of example and not by way of limitation. Various substitutions and modifications to the disclosed apparatus will occur to those of ordinary skill in the art, in addition to those already suggested. All such substitutions and modifications are intended to fall within the scope of the invention as defined in the appended claims.

What is claimed is:

1. An apparatus for receiving and applying labels, comprising:

an enclosure having a generally planar face plate formed with a plurality of openings therein communicating with the interior of the enclosure;

means for maintaining a partial vacuum within said enclosure in order to cause a label to adhere to the outside of the face plate;

means for causing the label to transfer from the face plate to a label receiving surface; and means on said face plate for causing the adhered label to bow outward from the plane of the face plate.

2. An apparatus as claimed in claim 1, wherein:

said face plate is formed with a plurality of raised parallel bars which are spaced apart from each other to define a grid-like label supporting surface; and said openings are formed in the area of the face plate between adjacent ones of said bars; and said means for causing the label to bow outward from the plane of the face plate comprises at least one of said bars which is raised outward from the plane of the face plate by a distance greater than others of said bars.

3. An apparatus as claimed in claim 1, wherein said means for maintaining a partial vacuum within the enclosure comprises a fan for continuously exhausting air from said enclosure.

4. An apparatus as claimed in claim 1, wherein said means for causing the label to transfer from the face plate to a label receiving surface comprises means for applying a burst of positive air pressure to the label sufficient to overcome the adherence of the label to the face plate and to propel the label toward the receiving surface.

5. An apparatus as claimed in claim 4, wherein said means for applying a burst of positive air pressure to the label comprises:

an air manifold adapted to be connected to a source of compressed air; and a plurality of conduits connected between said air manifold and selected ones of the openings in said face plate.

6. An apparatus as claimed in claim 5, wherein said conduits comprise flexible tubes releasably connected to the selected openings in the face plate, all of said flexible tubes being of approximately the same length.

* * * * *